US008464483B2

(12) United States Patent
Holt

(10) Patent No.: US 8,464,483 B2
(45) Date of Patent: Jun. 18, 2013

(54) INSULATION SYSTEM

(75) Inventor: John Timothy Holt, Akron, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 27 days.

(21) Appl. No.: 13/152,347

(22) Filed: Jun. 3, 2011

(65) Prior Publication Data

US 2011/0296785 A1 Dec. 8, 2011

Related U.S. Application Data

(60) Provisional application No. 61/351,517, filed on Jun. 4, 2010.

(51) Int. Cl.
*E04C 1/00* (2006.01)

(52) U.S. Cl.
USPC ..... 52/309.7; 52/309.8; 52/309.16

(58) Field of Classification Search
USPC ..... 52/309.7, 309.8, 309.16, 506.05, 52/539, 520, 521, 546, 552, 582.1, 592.1
See application file for complete search history.

(56) References Cited

U.S. PATENT DOCUMENTS 4,195,459 A * 4/1980 Anderson ..... 52/394
5,502,940 A * 4/1996 Fifield ..... 52/309.12
6,029,415 A * 2/2000 Culpepper et al. ..... 52/522
6,298,626 B2 * 10/2001 Rudden ..... 52/520
6,968,659 B2 * 11/2005 Boyer ..... 52/302.4
7,908,814 B2 * 3/2011 Wilson et al. ..... 52/519
7,980,038 B2 * 7/2011 O'Neal ..... 52/551
8,061,097 B2 * 11/2011 Holt et al. ..... 52/309.7
8,201,372 B2 * 6/2012 Holt et al. ..... 52/309.7
2005/0081468 A1 * 4/2005 Wilson et al. ..... 52/528
2005/0102944 A1 * 5/2005 Hikai ..... 52/511
2006/0075712 A1 * 4/2006 Gilbert et al. ..... 52/520
2006/0272261 A1 * 12/2006 Ito ..... 52/586.1
2007/0193177 A1 * 8/2007 Wilson et al. ..... 52/518
2009/0038252 A1 * 2/2009 King ..... 52/506.05
2009/0241459 A1 * 10/2009 Bryan ..... 52/539
2010/0263316 A1 * 10/2010 Bruneau ..... 52/546

* cited by examiner

*Primary Examiner* — Mark Wendell
(74) *Attorney, Agent, or Firm* — Richard M. Klein; Fay Sharpe LLP

(57) ABSTRACT

The present disclosure relates to an insulation system for securing cladding to the exterior surface of a building. An insulated panel has a front face and a rear face. Joining elements are defined in horizontal edges of the panel for connecting adjacent panels to each other. A horizontal attachment member, such as a nailing hem, is mounted to the rear face of the panel for attaching the insulated panel to the exterior surface. Receiving members are present on the front face of the panel, and can be located in receiving channels. The receiving member is generally made from a material that is better at retaining fasteners, such as nails, than the material of the insulated panel itself.

18 Claims, 7 Drawing Sheets

INSULATION SYSTEM

CROSS-REFERENCE TO RELATED APPLICATIONS

This application claims priority to U.S. Provisional Patent Application Ser. No. 61/351,517, filed Jun. 4, 2010. The disclosure of this application is hereby fully incorporated by reference herein.

BACKGROUND

The present disclosure relates to an insulation system for securing cladding to the exterior surface of a building, such as a house. In particular, the insulation system includes an insulated panel with integrated attachment members or components. The attachment members allow other panels, such as siding panels, to be joined or attached to the insulated panel more securely than otherwise possible. Methods and processes for making and/or using the insulation system are also disclosed.

Builders and contractors frequently add relatively thick layers of insulation (i.e. 1-6 inches or more) on the exterior of a building to meet the requirements of various energy codes and energy efficiency programs. For example, to enhance the thermal insulation of a building, a layer of insulation foam can be installed on an exterior wall. Cladding, such as siding panels, are subsequently mounted to the insulation. However, such layers of insulation are usually very thick, and are difficult to attach to the exterior wall. Furthermore, it can be equally difficult to attach cladding to the thick layers of insulation in a secure manner without causing pullout or shear stresses over time. Moreover, the addition of the insulation foam makes fastening the cladding directly to the exterior wall sometimes a "hit or miss" process.

It would be desirable to provide an insulation system that can be simply and easily installed to the exterior surface of a building, and that allows for secure mounting of cladding.

BRIEF DESCRIPTION

The present disclosure relates generally to insulation systems that allow for simple installation of both the insulation and subsequent cladding or facing members, such as siding panels, to the exterior surface of a building. An insulated panel has an integrated receiving member, to which the siding panels can be securely attached. Among other things, the receiving member generally comprises a material that has superior withdrawal resistance compared to the material of the insulated panel itself. The fasteners connecting the siding panels to the insulated panel are thus better retained and less susceptible to unintended pullout or withdrawal.

Disclosed in certain embodiments is an insulated panel that can be used for mechanically securing and attaching cladding to the exterior surface of a building. The insulated panel comprises a front face, a rear face, a first horizontal joining element defined in a first horizontal end edge, a second horizontal joining element defined in a second horizontal end edge, a first vertical end edge, a second vertical end edge, and at least one receiving receptacle or channel in the front face. An attachment member is mounted to the rear face and extends beyond the first horizontal end edge. At least one receiving member is located in the at least one receiving receptacle or channel. In particular embodiments, the receiving member is made from a material that has superior withdrawal resistance than the material of the insulated panel itself. The first and second horizontal joining elements may be substantially complementary in shape so that adjacent panels can engage each other.

The insulated panel may further comprise at least one support ridge extending from the front face of the insulated panel.

The at least one receiving channel may extend substantially from the first horizontal end edge to the second horizontal end edge of the insulated panel. In such embodiments, the receiving member may extend beyond one of the horizontal end edges, such as the second horizontal end edge.

The at least one receiving channel has a channel depth, and the at least one receiving member has a receiving member thickness. In some embodiments, the channel depth is substantially equal to the receiving member thickness, such that an outer face of the at least one receiving member is flush with the front face of the insulated panel and an inner face of the at least one receiving member is flush with a base face of the receiving channel.

In other embodiments, the channel depth is less than the receiving member thickness, and an outer face of the at least one receiving member is spaced apart from the front face of the insulated panel when an inner face of the at least one receiving member is flush with a base face of the receiving channel. A support ridge can also be used here, wherein an outer face of the support ridge and the receiving member outer face are equidistantly spaced apart from the front face of the insulated panel.

In other embodiments, the insulated panel has a plurality of receiving members, the receiving members being arranged in the front face so that a portion of each receiving member intersects a vertical axis running between the first horizontal end edge and the second horizontal end edge. In some more specific embodiments, a length of each receiving member is parallel to the vertical axis running between the first horizontal end edge and the second horizontal end edge, and a center of each receiving member lies on the vertical axis. In other more specific embodiments, a width of each receiving member is parallel to the vertical axis running between the first horizontal end edge and the second horizontal end edge, and a center of each receiving member lies on the vertical axis. In still other specific embodiments, a center of at least one receiving member does not lie on the vertical axis.

In some embodiments, the insulated panel has at least a first receiving channel and a second receiving channel. An interior section is defined between the first receiving channel and the second receiving channel, the interior section having an interior section width. An end section is defined between the first receiving channel and the first vertical end edge, the end section having an end section width. The end section width is about one-half of the interior section width.

The insulated panel can further comprise drainage grooves set at an angle relative to the first horizontal end edge. The drainage grooves are designed to keep moisture, vapors, and liquids away from the front or rear faces of the insulated panel.

The insulated panel can further comprise a first vertical joining element defined in the first vertical end edge and a second vertical joining element defined in the second vertical end edge; wherein the first and second vertical joining elements are substantially complementary in shape so that adjacent panels can engage each other.

As noted above, in particular embodiments, the insulated panel and the receiving member are made of different materials. The insulated panel preferably comprises a foam based insulation material, such as a cellular foamed product, that does not soak up or retain moisture. Other insulation materials are also contemplated. The receiving members are configured to receive and retain various types of mechanical fasteners (i.e. nails, screws, staples, etc.) which are used to secure the cladding to the insulated panel. The receiving member is made of a material that has better withdrawal resistance than the material from which the insulated panel is made. This inhibits withdrawal of the fasteners that may occur due to the weight of the cladding, environmental factors such as wind or water, etc.

Also disclosed in embodiments is an insulated panel for securing cladding to the exterior surface of a building. The insulated panel comprises a front face, a rear face, a first horizontal joining element defined in a first horizontal end edge, a second horizontal joining element defined in a second horizontal end edge, a first vertical end edge, and a second vertical end edge. An attachment member is mounted to the rear face and extends beyond the first horizontal end edge. At least one receiving member is attached to the front face of the insulated panel. The receiving member has better withdrawal resistance than the insulated panel. The first and second horizontal joining elements are substantially complementary in shape so that adjacent panels can engage each other.

Also disclosed in embodiments is a kit for adding insulation to the exterior surface of a building. The kit comprises a cladding member and a foam insulation panel. The foam insulation panel comprises a front face, a rear face, a first joining element defined in a first substantially horizontal end edge, and a second joining element defined in a second substantially horizontal end edge. A horizontal attachment member is mounted to the rear face and extends beyond the first substantially horizontal end edge. A receiving member is attached to the front face of the foam insulation panel, and is suitable for receiving an associated fastener to secure the cladding member to the foam insulation panel. The receiving member has greater withdrawal resistance than the insulated panel. The first and second joining elements may be substantially complementary in shape so that adjacent panels can engage each other.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
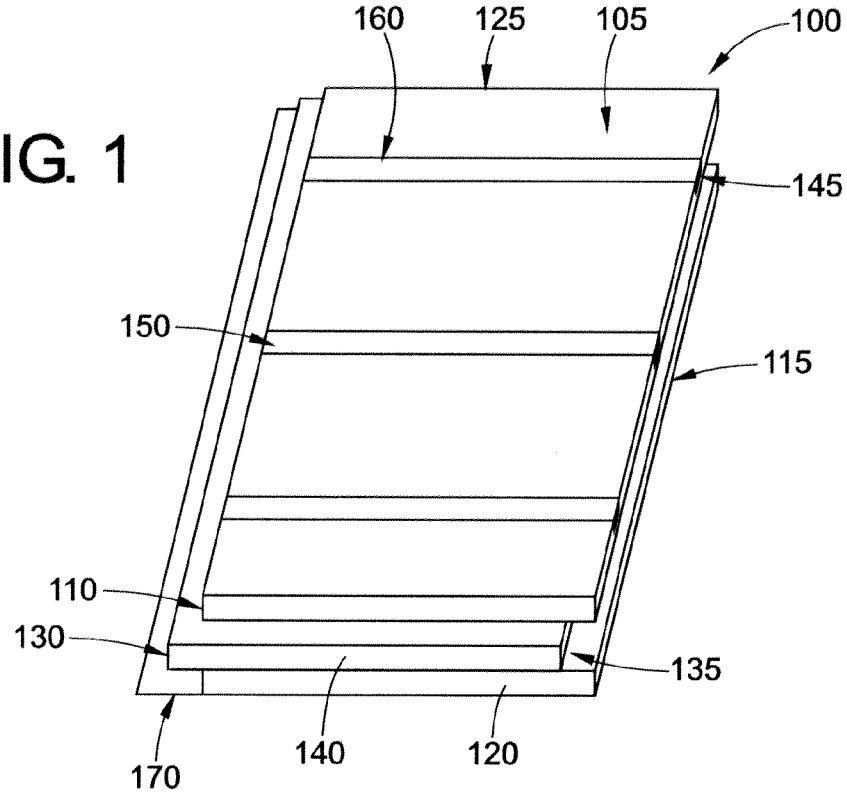
FIG. 1 is a front perspective view of a first exemplary embodiment of an insulated panel according to the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10."

The present disclosure relates to an insulation system that includes an insulated panel and cladding. The insulated panel includes integrated receiving members for enhancing the attachment of the cladding. The integral receiving members provide a more stable structure for fastening the cladding to the insulated panel. The insulated panel also includes an attachment member for mounting the insulated panel to the exterior surface of a building, such as a plywood sheathed wood or steel frame construction, concrete or brick wall, etc. Joining elements along the edges of the panel may also be used to allow adjacent panels to engage one another, eliminating thermal breaks between panels and creating a tight seal.

Figure 2:
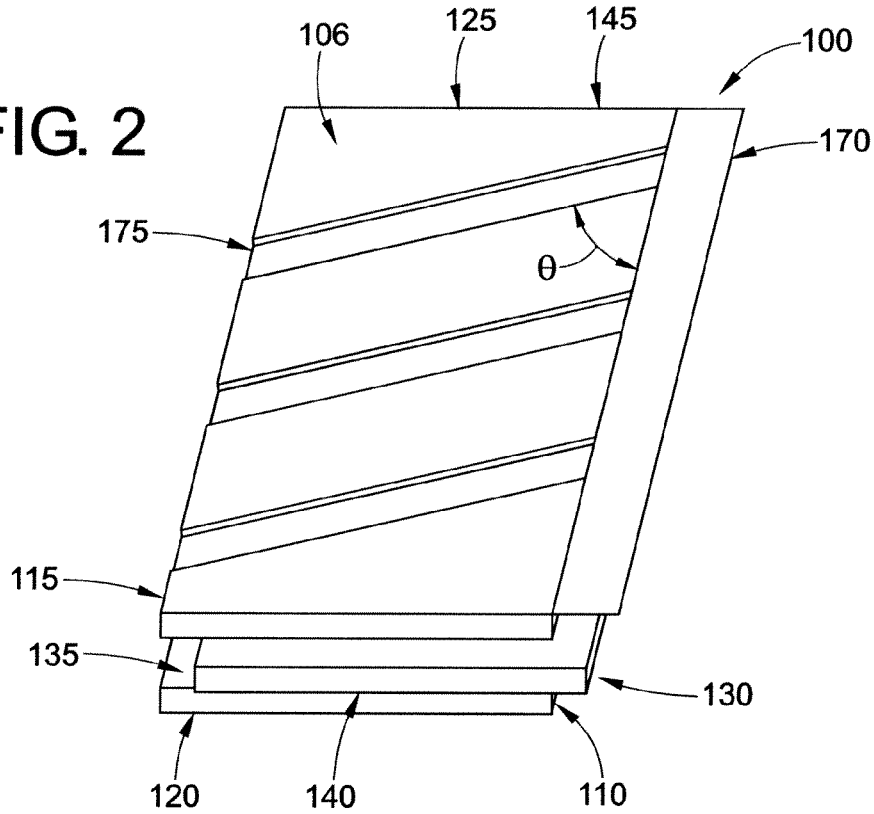
FIG. 2 is a rear perspective view of the insulated panel of FIG. 1.
Figure 3:
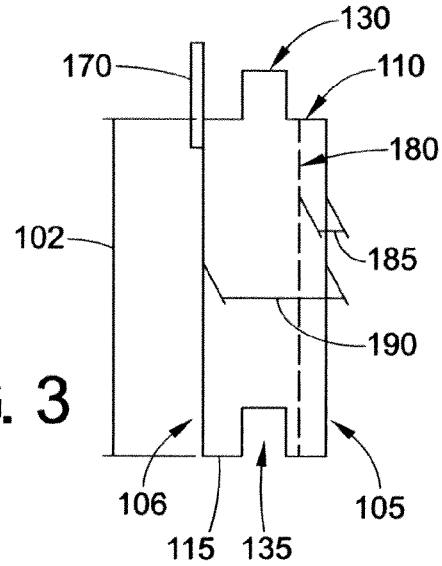
FIG. 3 is a side view of the insulated panel of FIG. 1.
Figure 4:
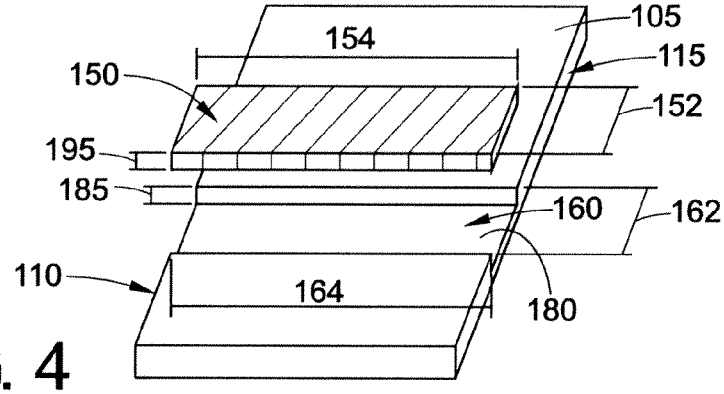
FIG. 4 is an enlarged front perspective view of the insulated panel of FIG. 1, showing a receiving member and a receiving channel in the front face of the insulated panel.
Figure 5:
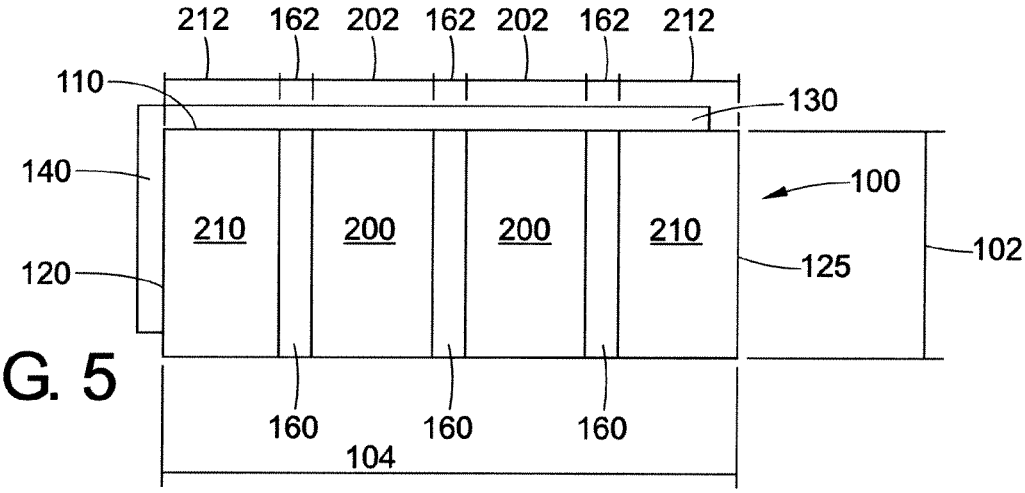
FIG. 5 is a front view of the insulated panel of FIG. 1.

FIGS. 1-5 illustrate a first exemplary embodiment of an insulated panel used in the insulation system. FIG. 1 is a front perspective view, FIG. 2 is a rear perspective view, FIG. 3 is a side view, FIG. 4 is an enlarged view of the front face of the insulated panel, and FIG. 5 is a front view.

The insulated panel 100 comprises a front face 105 and a rear face 106. A first horizontal end edge 110 and a second horizontal end edge 115 join the front face 105 and rear face 106. The first horizontal end edge 110 and the second horizontal end edge 115 are substantially parallel to each other. A first vertical end edge 120 and a second vertical end edge 125 also join the front face 105 and rear face 106. The first vertical end edge 120 and second vertical end edge 125 are substantially parallel to each other. The insulated panel has a height 102, a width 104, and a thickness 190.

A first horizontal joining element 130 is defined in the first horizontal end edge 110 and a second horizontal joining element 135 is defined in a second horizontal end edge 115. The first horizontal joining element 130 and the second horizontal joining element 135 are substantially complementary in shape, so that adjacent panels can engage each other. If desirable or needed, a first vertical joining element 140 can be defined in the first vertical end edge 120 and a second vertical joining element 145 can be defined in the second vertical end edge 125. The first vertical joining element 140 and the second vertical joining element 145 are also substantially complementary in shape so that adjacent panels can engage each other. As shown here, the first horizontal joining element 130 is a tongue, and the second horizontal joining element 135 is a groove. The first vertical joining element 140 and second vertical joining element 145 may also form a tongue-and-groove combination. Generally speaking, one joining element is a male element, and the other joining element is a female element. Any male/female relationship may be used for the various joining elements. There is no requirement that all male/female elements have the same size, shape, or relative dimensions.

As seen in FIG. 2, an attachment member 170 is mounted to the rear face 106. The attachment member extends beyond the first horizontal end edge 110. Although not shown here, a portion of the rear face 106 near the second horizontal end edge may be sized, for example, to form a recess, so that adjacent panels can overlap without being displaced away from the exterior wall of the building by the attachment member. Drainage grooves 175 are also shown in the rear face 106. The drainage grooves 175 are set at an angle θ relative to the first horizontal end edge 110. In embodiments, the angle θ may be at least 5 degrees.

Returning to FIG. 1, in some embodiments, a plurality of support ridges can extend from the front face 105. As will be explained later, the support ridges can be used to provide support to certain types of siding panels.

At least one receiving channel 160 is present in the front face 105 of the insulated panel 100. As shown in FIG. 1, the insulated panel has three receiving channels 160. At least one receiving member 150 is located in each receiving channel 160. Each receiving channel 160 is shown here as extending substantially from the first horizontal end edge 110 to the second horizontal end edge 115. Also, each receiving channel 160 is shown here as being substantially perpendicular to the first horizontal end edge 110, or put another way, as being substantially parallel to the first vertical end edge 120.

Referring now to the side view of FIG. 3, the first horizontal joining element 130 and the second horizontal joining element 135 are depicted as extending along the entire width of the insulated panel 100. This is not a required feature. For example, the male joining element can be a series of merlons, and the female joining element can be a series of crenels for receiving the merlons. In addition, the receiving channel 160 has a channel depth 185 from the front face 105 to a base face 180. The receiving channel generally does not extend into the joining elements. The insulated panel has a thickness 190, and the channel depth 185 is also less than the panel thickness 190. The insulated panel height 102 is also marked here.

FIG. 4 is an enlarged perspective view of the front face 105 of the insulated panel, and shows the receiving member 150 separated from the receiving channel 160 (i.e. prior to integration of the insulated panel and the receiving member). The receiving channel includes a base face 180 which is spaced apart from the front face 105 into the insulated panel 100 by a receiving channel depth 185. The receiving channel also has a length 164 and a width 162. The receiving member has a thickness 195, a length 154, and a width 152. In some embodiments, the receiving member thickness 195 is substantially equal to the receiving channel depth 185. In other embodiments, the receiving member thickness 195 is less than the receiving channel depth 185. Here, the receiving member is shown as a rectangle. The receiving member may generally have any shape (e.g. trapezoidal), but presents a rectangular shape on the front face of the insulated panel. It should be noted that the length 154 and width 152 of the receiving member 150 are measured on the front face 105 of the insulated panel 100, rather than along base face 180. Alternatively, the receiving member 150 can be described as being attached to the front face of the insulated panel 100.

FIG. 5 is a front view of the insulated panel 100. As seen here, the three receiving channels 160 divide the insulated panel into interior sections 200 and end sections 210. Each interior section 200 also has an interior section width 202, and each end section 210 has an end section width 212. The end section width 212 runs from a receiving channel 160 to a vertical end edge 120, 125. In embodiments, the end section width 212 is about one-half of the interior section width 202. When adjacent panels are subsequently lined up, these values result in receiving channels being separated by a constant width. The height 102 and width 104 of the insulated panel are also shown here. First horizontal joining element 130 extends beyond first horizontal end edge 110. First vertical joining element 140 extends beyond first vertical end edge 120.

Figure 6:
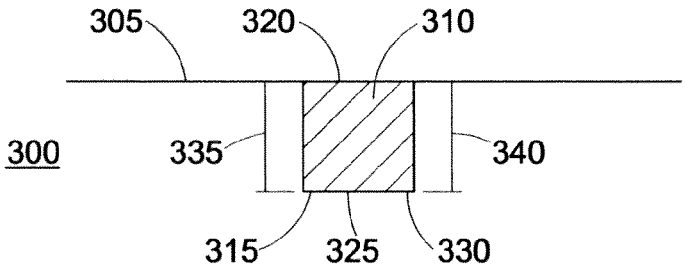
FIG. 6 is a bottom view showing one placement of a receiving member in a receiving channel of an insulated panel.

FIG. 6 is a bottom view of part of an exemplary embodiment of an insulated panel 300. A receiving channel 315 is located in the front face 305 of the panel 300. A receiving member 310 is located in the receiving channel 315. Here, the depth 335 of the receiving channel 315 is substantially equal to the thickness 340 of the receiving member 310. In such embodiments, the outer face 320 of the receiving member 310 is flush with the front face 305 of the insulated panel 300. An inner face 325 of the receiving member 310 is flush with a base face 330 of the receiving channel 315. It should be noted that FIG. 6 does not show the entirety of the second horizontal end edge.

The insulated panel (reference numeral 100 in FIG. 1) can generally be made from any acceptable insulating material, such as expanded polystyrene (EPS), extruded polystyrene, polyisocyanurate, rock wool, or polyurethane. Other suitable materials for the insulated panel can include expandable polystyrene (XPS), polyethylene, and polypropylene.

The insulated panel may be shape molded. Such molding operations will generally impart the desired contours and/or design to the insulated panel. Typically, pellets of a polymeric precursor material are placed in a suitably configured die mold, then reacted in the presence of water and heat to expand during the reaction process. The polymeric precursor material expands and presses against the die surface to form compressed elongated closed cells that form a characteristic tough smooth skin. The shape molded process produces a panel that is essentially straight, free of camber, and/or self-supporting. The various grooves, slots, channels, and ridges of the insulated panel may be obtained by any combination of computer numerical control (CNC) cutting, milling, wire-cutting, or during the shape molding process as well. Alternately, the insulated panel could be fabricated from sheets of insulation material which are joined together.

The insulated panel is generally made from a cellular foam product, i.e. a plastic or polymeric material with numerous cells of trapped air distributed throughout its mass. For example, expanded polystyrene (EPS) is a cellular foam plastic made from beads of polystyrene beads that are first pre-expanded and allowed to rest for a suitable interval, then molded in closed steam-heated shaped molds to produce closed-cell molded foams. The size and density of the closed cells can be controlled and may vary depending upon the application.

The insulated panel can be of any density desired, or be tuned to provide different densities depending on the location. For example, it may be desirable to have higher densities where the insulated panel is thin, and lower densities where the panel is thicker. Similarly, it may be desirable to have higher densities near the edges of the insulated panel where connections between panels are made, and lower densities near the center of the insulated panel (which are covered by cladding).

Expanded or expandable polystyrene are particularly desirable materials for the insulated panel because they provide a solid feel; improve the R-value; deaden noise transmitted through the siding; and channel heat and water away into the external environment, protecting the exterior wall behind the insulated panel and minimizing mold and insect growth (e.g. termites, etc.).

The various slots, grooves, channels, and ridges could also be made out of different materials, such as plastics or metals, instead of being milled or wire-cut from a foamed sheet. Those pre-formed pieces could be inserted into a flat foamed sheet and fastened with adhesive, tape, screws, or other mechanical fasteners. Alternatively, the pre-formed pieces could be inserted into the foamed sheet or fastened mechanically during the shape molding process. The plastic or metal piece could be inserted and the foam would be expanded and fused around it. No secondary fasteners or additional fastening step would be required.

The insulated panel 100 can have a thickness 190 of from about 1 inch to about 20 inches. The insulated panel can have a height 102 of from about 8 inches to about 96 inches. The insulated panel can have a width 104 of from about 12 inches to about 96 inches. Preferably, the insulated panel sheds water, though it may be semi-permeable to vapor.

The receiving member 150 can have a thickness 195 of from about 0.25 inches to about 6 inches. The receiving member can have a length 154 of from about 24 inches to about 144 inches. The receiving member can have a width 152 of from about 0.25 inches to about 6 inches.

The attachment member (reference numeral 170 in FIG. 1) and receiving member (reference numeral 150 in FIG. 1) are independently manufactured from plastic, rubber, metal, wood, or wood-plastic composites. In particular embodiments, the insulated panel and the receiving member are made from different materials. Desirably, the receiving member is a material that is more able to hold fasteners (such as nails, screws, or staples) than the material of the insulated panel. In particular, the receiving member has greater withdrawal resistance than the insulated panel. In specific embodiments, the receiving member is wood. Withdrawal resistance can be determined by using the procedures set forth in ASTM D1761, which is incorporated herein by reference in its entirety.

The attachment member and receiving member(s) are independently mounted to the insulated panel with an adhesive, a friction-fit design, a fastener, by chemical bonding, or combinations thereof. Typically, however, adhesives are used. The adhesive may be used over the entire surface of the siding panel or in discrete locations instead. Suitable adhesives may include, but are not limited to, UV curable adhesives and hot melt adhesives, such as polyamines and urethanes, glue, thermosetting or thermoplastic adhesives, pressure sensitive adhesives or solvent-based adhesives.

Other embodiments and variations on the insulation system of the present disclosure are contemplated. For example, rather than a single receiving channel 160 or a single receiving member 150 extending substantially from the first horizontal end edge to the second horizontal end edge as shown in FIG. 1, multiple receiving channels or receiving members could be used along a single axis to achieve the same effect.

Figure 7:
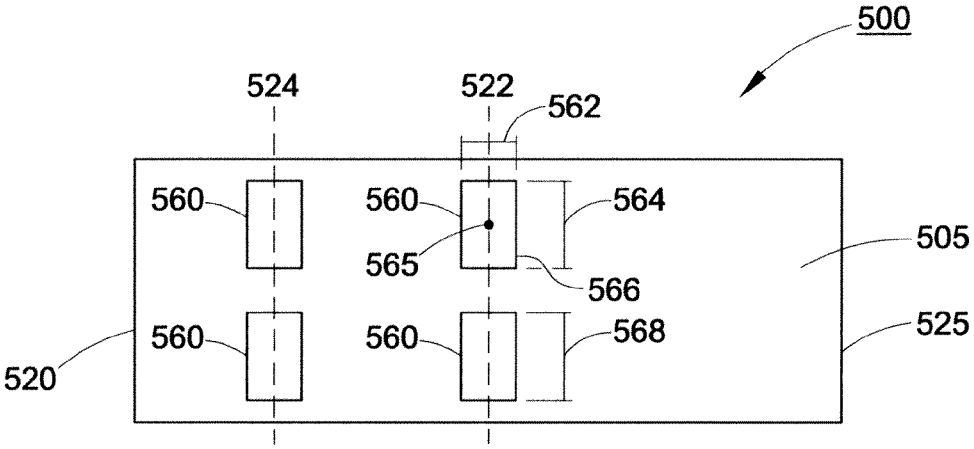
FIG. 7 is a front view of another exemplary embodiment of an insulated panel of the present disclosure, showing one variation in the placement of receiving members on the front face of an insulated panel.

FIG. 7 is a front view of an insulated panel 500 that illustrates this variation. Here, two imaginary vertical axes 522, 524 are shown on the front face 505 of the panel 500. The vertical axes are parallel to the vertical end edges 520, 525. A plurality of receiving members 560 are shown on each axis 522, 524. Each receiving member 560 has a length 564, a width 562, and a center 565. It should be noted that the term "length", when used in reference to the receiving member, refers to the longer dimension of the receiving member 560 on the front face 505, and the term "width", when used in reference to the receiving member, refers to the shorter dimension of the receiving member 560 on the front face 505. Here, the receiving members 560 are placed so that their length 564 is parallel to the imaginary vertical axis 522, 524 and their center 565 is on the imaginary vertical axis 522, 524. Short receiving members 566, 568 on imaginary vertical axis 522 act as a single longer receiving member.

Figure 8:
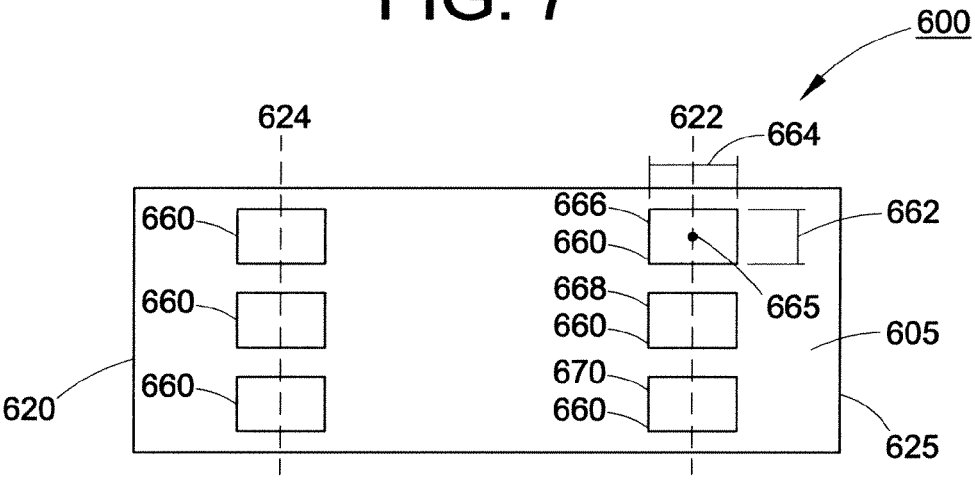
FIG. 8 is a front view of another exemplary embodiment of an insulated panel of the present disclosure, showing another variation in the placement of receiving members on the front face of an insulated panel.
Figure 9:
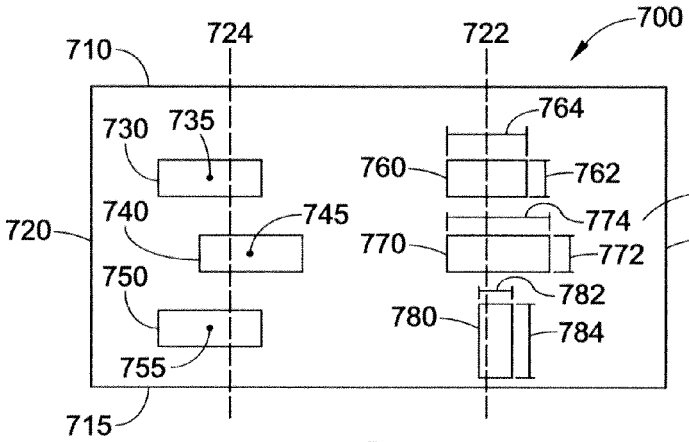
FIG. 9 is a front view of another exemplary embodiment of an insulated panel of the present disclosure, showing other variations in the placement of receiving members on the front face of an insulated panel.

The orientation and the size of the receiving members may vary as well. FIG. 8 and FIG. 9 show two different embodiments illustrating some possible variations.

In FIG. 8, two imaginary vertical axes 622, 624 are shown on the front face 605 of the panel 600. The vertical axes are parallel to the vertical end edges 620, 625. A plurality of receiving members 660 are shown on each axis 622, 624. Each receiving member 660 has a length 664, a width 662, and a center 665. Here, the receiving members 660 are placed so that their width 662 is parallel to the imaginary vertical axis 622, 624 and their center 665 is on the imaginary vertical axis 622, 624. Short receiving members 666, 668, 670 on imaginary vertical axis 622 act as a single longer receiving member.

FIG. 9 illustrates two different variations. Two imaginary vertical axes 722, 724 are shown on the front face 705 of the panel 700. The vertical axes are parallel to the vertical end edges 720, 725. One variation is shown on vertical axis 724. Three receiving members 730, 740, 750 are shown here intersecting imaginary vertical axis 724. Each receiving member 730, 740, 750 has a center 735, 745, 755. Here, the receiving members 730, 740, 750 are placed so that a portion of each receiving member intersects the imaginary vertical axis 724. Put another way, the outer face of each receiving member intersects the imaginary vertical axis. Unlike the embodiments shown in FIG. 7 and FIG. 8, the center 735, 745, 755 of each receiving member is not required to be on the imaginary vertical axis 724. Put another way, the center of at least one receiving member is not on the imaginary vertical axis 724.

A second variation is shown on vertical axis 722. Three receiving members 760, 770, 780 are shown here intersecting imaginary vertical axis 722. Receiving member 760 has a length 764 and a width 762. Receiving member 770 has a length 774 and a width 772. Receiving member 780 has a length 784 and a width 782. Again, the receiving members 760, 770, 780 are placed so that they intersect the imaginary vertical axis 722. Here, the receiving members are oriented so that a length is parallel to either a horizontal end edge 710, 715 or a vertical end edge 720, 725. The width of each receiving member is also parallel to either a vertical end edge 720, 725 or a horizontal end edge 710, 715. For example, receiving members 760 and 770 have their lengths 764, 774 parallel to horizontal end edge 710, while receiving member 780 has its length 784 parallel to vertical end edge 725. In addition, the relative dimensions of the receiving members differ. For example, the length 764 of receiving member 760 differs from the length 774 of receiving member 770.

In FIGS. 7-9, all of the receiving members can be considered as being placed in receiving channels, so that the description of the relative locations and orientations of the receiving members also applies to the receiving channels in the insulated panel.

In specific embodiments, the receiving members all have the same length and the same width; the receiving members are all oriented so that their length is parallel to a horizontal end edge or a vertical end edge; and the center of each receiving member is located on a vertical axis.

Figure 11:
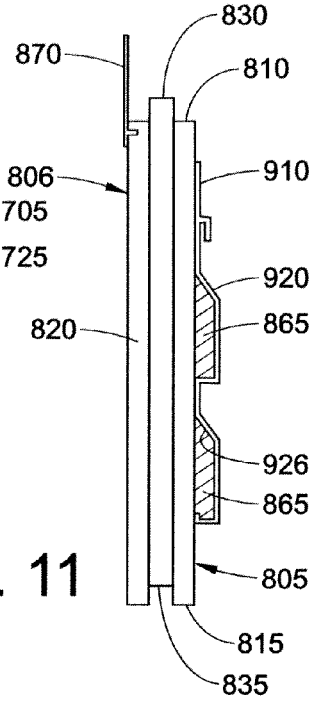
FIG. 11 is a side view of the insulation system of FIG. 10.
Figure 10:
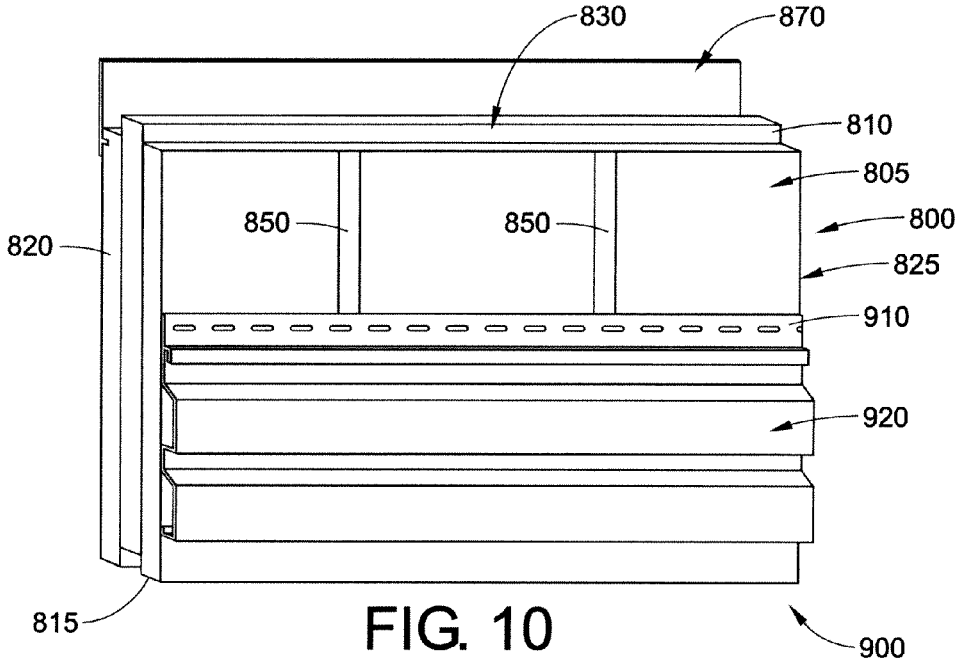
FIG. 10 is a front perspective view showing a foam insulation panel of the present disclosure along with a siding panel secured to the front face of the insulation panel.

The insulated panels described herein are part of an insulation system that also includes cladding, such as siding panels. The cladding can be made from materials such as vinyl, polyvinyl chloride (PVC), aluminum, fiber cement, stucco, etc. FIG. 10 and FIG. 11 show an insulated panel being used with a siding panel. FIG. 10 is a front perspective view, and FIG. 11 is a side view.

FIG. 10 shows an insulation system comprising a foam insulation panel 800 and a cladding member, shown here as a siding panel 900. The foam insulation panel has a front face 805 and a rear face 806. A first horizontal end edge 810 and a second horizontal end edge 815 join the front face 805 and rear face 806. The first horizontal end edge 810 and the second horizontal end edge 815 are substantially parallel to each other. A first horizontal joining element 830 is defined in the first horizontal end edge 810 and a second horizontal joining element 835 is defined in a second horizontal end edge 815; the two joining elements are complementary. A first vertical end edge 820 and a second vertical end edge 825 also join the front face 805 and rear face 806. The first 820 and second vertical end edge 825 are substantially parallel to each other. Though not shown here, a first vertical joining element can be defined in the first vertical end edge 820 and a second vertical joining element can be defined in the second vertical end edge 825 as seen in the embodiment of FIGS. 1-5; the two joining elements are complementary.

A horizontal attachment member 870 is mounted to the rear face 806 and extends beyond the first horizontal end edge 810. Receiving members 850 are attached to the front face 805 of the foam insulation panel and extend vertically from the first horizontal end edge 810 to the second horizontal end edge 815. A siding panel 900 is mounted to the front face 805 of the foam insulation panel 800, parallel to the horizontal end edge. The siding panel 900 includes an attachment rail 910 and a facing panel 920. Fasteners, such as nails, are inserted through the attachment rail 910 along the length of the siding panel 900 and into the receiving members 850 of the foam insulation panel 900.

In FIG. 11, support ridges 865 are seen extending from the front face 805 of the foam insulation panel. In cases where the siding panel is relatively thin or flexible, the support ridges provide additional support to the siding panel. Here, the siding panel 900 is shaped such that the attachment rail 910 lies against the front face 805 of the foam insulation panel, and the facing panel 920 is spaced from the front face 805. The support ridges 865 extend from the front face 805 to contact the rear face 926 of the facing panel 920.

Figure 12:
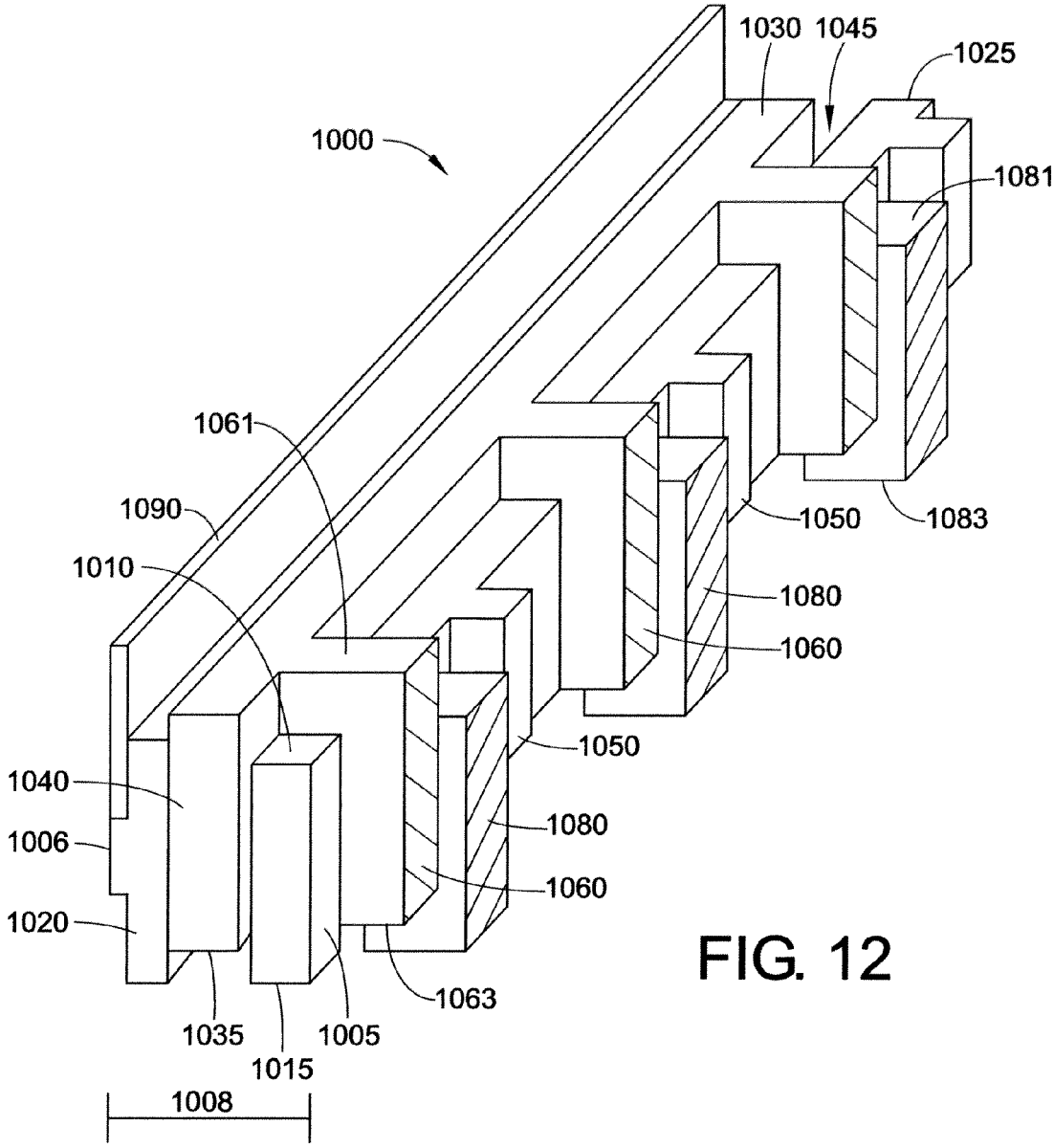
FIG. 12 is a perspective view of another exemplary embodiment of an insulated panel, wherein the receiving member is spaced outwards from the front face, so a drainage plane is created along the front face behind the cladding.
Figure 13:
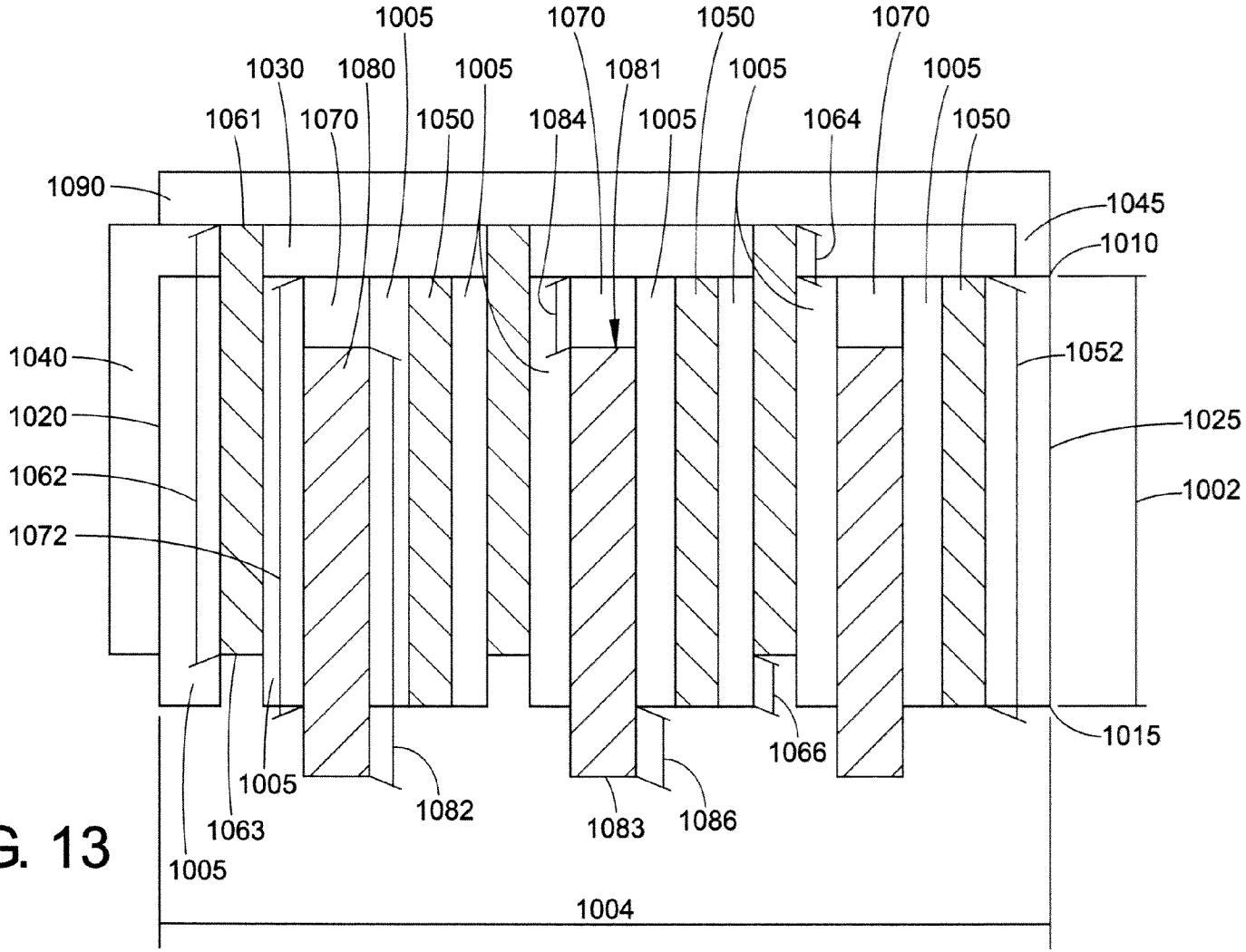
FIG. 13 is a front view of the insulated panel of FIG. 12.
Figure 14:
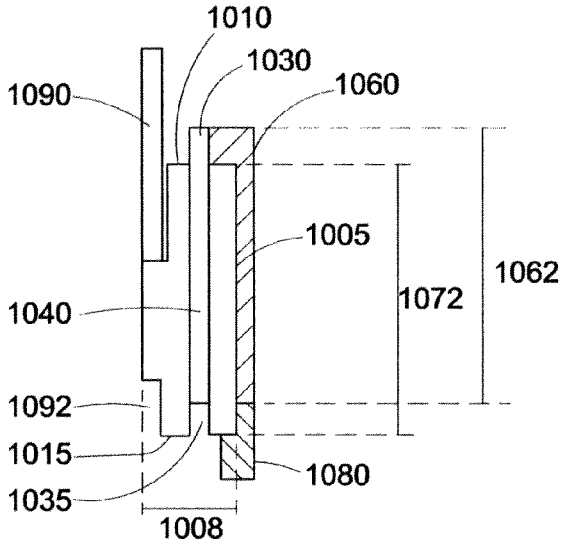
FIG. 14 is a side view of the insulated panel of FIG. 12.
Figure 15:
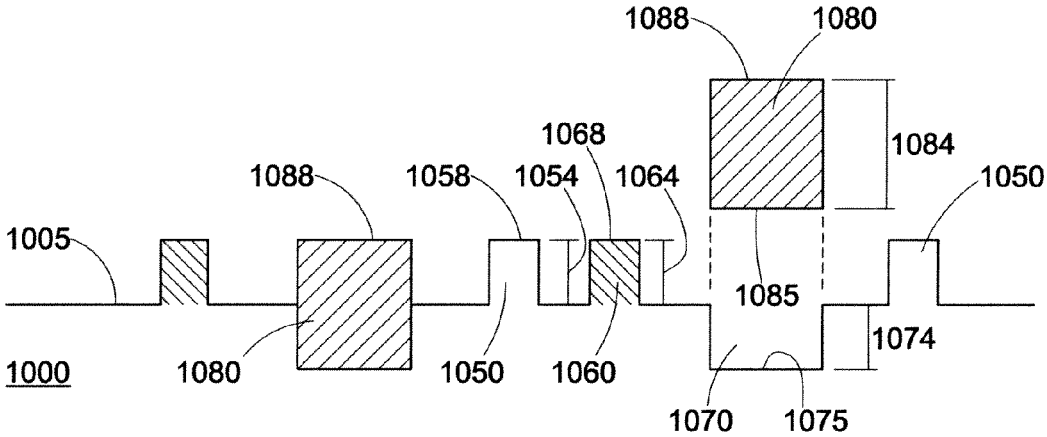
FIG. 15 is a bottom view of the insulated panel of FIG. 12.

FIGS. 12-15 illustrate a second exemplary embodiment of an insulated panel that can be used in the insulation system. FIG. 12 is a front perspective view, FIG. 13 is a front view, FIG. 14 is a side view, and FIG. 15 is a bottom view.

The insulated panel 1000 comprises a front face 1005 and a rear face 1006. A first horizontal end edge 1010 and a second horizontal end edge 1015 join the front face 105 and rear face 1006. The first horizontal end edge 1010 and the second horizontal end edge 1015 are substantially parallel to each other. A first vertical end edge 1020 and a second vertical end edge 1025 also join the front face 1005 and rear face 1006. The first vertical end edge 1020 and the second vertical end edge 1025 are substantially parallel to each other. The insulated panel has a height 1002, a width 1004, and a thickness 1008. An attachment member 1090 is mounted to the rear face 1006.

A first horizontal joining element 1030 is defined in the first horizontal end edge 1010 and a second horizontal joining element 1035 is defined in a second horizontal end edge 1015. The first horizontal joining element 1030 and the second horizontal joining element 1035 are substantially complementary in shape, so that adjacent panels can engage each other. A first vertical joining element 1040 defined in the first vertical end edge 1020 and a second vertical joining element 1045 defined in the second vertical end edge 1025 are also shown here. The first vertical joining element 1040 and the second vertical joining element 1045 are also substantially complementary in shape so that adjacent panels can engage each other.

Two types of support ridges are present. The first type is a set of support ridges 1050 that extend away from the front face 1005. These support ridges 1050 also extend from the first horizontal end edge 1010 to the second horizontal end edge 1015. The second type is a combination of a joining element and a support ridge and is referred to here as a support joint. The support joint 1060 also extends away from the front face 1005. At the top of the insulated panel, the support joint 1060 extends vertically from the first horizontal end edge 1010 to the same height as the first joining element 1030. At the bottom of the insulated panel, the support joint 1060 does not extend to the second horizontal end edge 1015. The support joint 1060 could be considered as having substantially the same length 1062 as the length 1052 of the support ridge, and be translated along the vertical direction.

At least one receiving channel 1070 is present in the front face 1005 of the insulated panel 1000. The insulated panel is depicted here with three receiving channels 1070. Each receiving channel 1070 is shown here as extending substantially from the first horizontal end edge 1010 to the second horizontal end edge 1015. Also, each receiving channel 1070 is shown here as being substantially perpendicular to the first horizontal end edge 1010, or put another way, as being substantially parallel to the first vertical end edge 1020. The receiving channel 1070 has a length 1072.

A receiving member 1080 is located in the receiving channel 1070. The receiving member has a length 1082. At the bottom of the insulated panel, the receiving member 1080 extends beyond the second horizontal end edge 1015. At the top of the insulated panel, the receiving member 1080 does not extend to the first horizontal end edge 1010. The receiving member length 1082 could be considered as being substantially equal to the receiving channel length 1072, and be translated along the vertical direction.

Referring to FIG. 13, the first end 1061 of the support joint 1060 extends above the first horizontal end edge 1010 and the second end 1063 stops before reaching the second horizontal end edge 1015. The distance from the first horizontal end edge 1010 to the first end 1061 of the support joint is indicated with reference numeral 1064, and the distance from the second horizontal end edge 1015 to the second end 1063 of the support joint is indicated with reference numeral 1066. The distances 1064 and 1066 are substantially equal. Similarly, the second end 1083 of the receiving member 1080 extends below the second horizontal end edge 1015 and the first end 1081 stops before reaching the first horizontal end edge 1010. The distance from the first horizontal end edge 1010 to the first end 1081 of the receiving member is indicated with reference numeral 1084, and the distance from the second horizontal end edge 1015 to the second end 1083 of the receiving member is indicated with reference numeral 1086. The distances 1084 and 1086 are substantially equal. Generally speaking, an end 1081, 1083 of the receiving member may extend beyond a horizontal end edge 1010, 1015 when the length of the receiving member 1082 is substantially equal to or less than the receiving channel length 1072. It should also be noted that the support ridges 1050, support joints 1060, receiving channels 1070, and receiving members 1080 are substantially parallel to each other, and are substantially parallel to the vertical end edges 1020, 1025 or substantially perpendicular to the horizontal end edges 1010, 1015.

Referring now to FIG. 14, an attachment member 1090 is mounted to the rear face 1006. The attachment member extends beyond the first horizontal end edge 1015. A recess 1092 is also formed in the rear face 1006 near the second horizontal end edge and is sized to receive the attachment member 1090 so that adjacent panels can overlap without being displaced by the attachment member. Support joint 1060 is seen to extend vertically beyond the first horizontal end edge 1010, and to extend laterally away from the front face 1005. Receiving member 1080 extends vertically downwards beyond the second horizontal end edge 1015.

FIG. 15 is a bottom view of the insulated panel 1000. Only two of the receiving channels 1070 are shown here. One receiving channel is shown containing a receiving member 1080, while the other receiving channel is shown with the receiving member suspended overhead. Support ridge 1050 extends away from the front face 1005 for a depth 1054 and has an outer face 1058. Support joint 1060 also extends away from the front face 1005 for a depth 1064 and has an outer face 1068. Each receiving channel 1070 has a depth 1074 and a base face 1075 which is located within the insulated panel. The receiving member 1080 has a thickness 1084, an outer face 1088, and an inner face 1085. When the receiving member 1080 is placed into the receiving channel 1070, the inner face 1085 of the receiving member is flush with the base face 1075 of the receiving channel. In addition, the support ridge depth 1054, support joint depth 1064, and receiving member thickness 1084 are selected so that the support ridge outer face 1058, support joint outer face 1068, and receiving member outer face 1088 are spaced outwards from the front face 1005 of the insulated panel and are substantially equidistant from the front face 1005. Put another way, the support ridge outer face 1058, support joint outer face 1068, and receiving member outer face 1088 are substantially coplanar.

The variations shown in FIGS. 7-9 may also be applied to the insulated panel of FIG. 12.

When the insulated panel 1000 is used, it is contemplated that the cladding is attached to the outer face 1088 of the receiving member 1080 and remains spaced apart from the front face 1005 of the insulated panel 1000. The front face can then act as a drainage plane.

The insulation systems of the present disclosure improve the ease, speed, and quality of installation of insulation on the interior or the exterior of a building. They also improve the ease, speed, and quality of the attachment of the cladding to the insulation.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An insulated panel for securing cladding to the surface of a building, the insulated panel comprising:

a front face, a rear face, a first horizontal joining element defined in a first horizontal end edge, a second horizontal joining element defined in a second horizontal end edge, a first vertical end edge, a second vertical end edge, and at least one receiving channel in the front face;

an attachment member for securing the insulated panel to the surface of a building, the attachment member being mounted to the rear face and extending beyond the first horizontal end edge; and at least one receiving member for securing cladding to the insulated panel, the at least one receiving member being located in the at least one receiving channel and having an outer face into which an associated fastener can be inserted;

wherein the at least one receiving member has greater withdrawal resistance than the front face; and wherein the at least one receiving channel extends substantially from the first horizontal end edge to the second horizontal end edge of the insulated panel.

2. The insulated panel of claim 1, wherein the at least one receiving member extends beyond the second horizontal end edge.

3. The insulated panel of claim 1, wherein the at least one receiving channel has a channel depth, the at least one receiving member has a receiving member thickness, and the channel depth is substantially equal to the receiving member thickness, such that the outer face of the at least one receiving member is flush with the front face of the insulated panel and an inner face of the at least one receiving member is flush with a base face of the receiving channel.

4. The insulated panel of claim 1, wherein the at least one receiving channel has a channel depth, the at least one receiving member has a receiving member thickness, and the channel depth is less than the receiving member thickness such that the outer face of the at least one receiving member is spaced apart from the front face of the insulated panel and an inner face of the at least one receiving member is flush with a base face of the receiving channel.

5. The insulated panel of claim 1, further comprising at least one support ridge extending from the front face of the insulated panel, the support ridge having an outer face, wherein the receiving member outer face and the support ridge outer face are equidistantly spaced apart from the front face of the insulated panel.

6. The insulated panel of claim 1, having at least a first receiving channel and a second receiving channel:

wherein an interior section is defined between the first receiving channel and the second receiving channel, the interior section having an interior section width;

wherein an end section is defined between the first receiving channel and the first vertical end edge, the end section having an end section width; and wherein the end section width is about one-half of the interior section width.

7. The insulated panel of claim 1, wherein the insulated panel further comprises drainage grooves set at an angle relative to the first horizontal end edge.

8. The insulated panel of claim 1, wherein the insulated panel is made from expanded polystyrene, extruded polystyrene, polyisocyanurate, rock wool, or polyurethane.

9. The insulated panel of claim 1, wherein the horizontal attachment member and the at least one receiving member are independently manufactured from plastic, rubber, metal, wood, or wood-plastic composites.

10. The insulated panel of claim 1, wherein one of the horizontal joining elements is a tongue and the other horizontal joining element is a groove.

11. The insulated panel of claim 1, wherein the horizontal attachment member and the at least one receiving member are independently mounted to the insulated panel with an adhesive, a friction-fit design, a fastener, by chemical bonding, or combinations thereof.

12. The insulated panel of claim 1, further comprising a first vertical joining element defined in the first vertical end edge and a second vertical joining element defined in the second vertical end edge; wherein the first and second vertical joining elements are substantially complementary in shape so that adjacent panels can engage each other.

13. An insulated panel for securing cladding to the surface of a building, the insulated panel comprising:

a front face, a rear face, a first horizontal joining element defined in a first horizontal end edge, a second horizontal joining element defined in a second horizontal end edge, a first vertical end edge, a second vertical end edge, and at least one receiving channel in the front face;

an attachment member for securing the insulated panel to the surface of a building, the attachment member being mounted to the rear face and extending beyond the first horizontal end edge; and a plurality of receiving members for securing cladding to the insulated panel, each receiving member being located in the at least one receiving channel and having an outer face into which an associated fastener can be inserted, and each receiving member has greater withdrawal resistance than the front face, and the receiving members being arranged in the front face so that a portion of each receiving member intersects a vertical axis running between the first horizontal end edge and the second horizontal end edge.

14. The insulated panel of claim 13, wherein a length of each receiving member is parallel to the vertical axis running between the first horizontal end edge and the second horizontal end edge, and a center of each receiving member lies on the vertical axis.

15. The insulated panel of claim 13, wherein a width of each receiving member is parallel to the vertical axis running between the first horizontal end edge and the second horizontal end edge, and a center of each receiving member lies on the vertical axis.

16. The insulated panel of claim 13, wherein a center of at least one receiving member does not lie on the vertical axis.

17. An insulated panel for securing cladding to the surface of a building, comprising:

a foam panel having a front face, a rear face, a first horizontal joining element defined in a first horizontal end edge, a second horizontal joining element defined in a second horizontal end edge, a first vertical end edge, and a second vertical end edge;

an attachment member mounted to the rear face and extending beyond the first horizontal end edge; and at least one rectangular receiving member attached to the front face of the foam panel, the at least one receiving member having greater withdrawal resistance than the foam panel and presenting a rectangular shape on the front face of the foam panel;

wherein the first and second horizontal joining elements are substantially complementary in shape so that adjacent panels can engage each other; and wherein the at least one rectangular receiving member extends substantially from the first horizontal end edge to the second horizontal end edge of the insulated panel.

18. A kit for adding insulation to the surface of a building, comprising:

a cladding member;

a foam insulation panel comprising a front face, a rear face, a first joining element defined in a first substantially horizontal end edge, and a second joining element defined in a second substantially horizontal end edge;

a horizontal attachment member mounted to the rear face and extending beyond the first substantially horizontal end edge; and a receiving member attached to the front face of the foam insulation panel, suitable for receiving an associated fastener to secure the cladding member, the receiving member having greater withdrawal resistance than the foam insulation panel and having an outer face into which the associated fastener can be inserted; and wherein the at least one rectangular receiving member extends substantially from the first substantially horizontal end edge to the second substantially horizontal end edge of the insulated panel.

* * * * *